US012222130B2

(12) United States Patent
Regnier

(10) Patent No.: US 12,222,130 B2
(45) Date of Patent: Feb. 11, 2025

(54) SYSTEM AND METHOD FOR IMPROVING AIR-QUALITY OF A SPACE SERVICED BY AN EXIT REGISTER

(71) Applicant: Jon O. Regnier, Santa Ana, CA (US)

(72) Inventor: Jon O. Regnier, Santa Ana, CA (US)

( * ) Notice: Subject to any disclaimer, the term of this patent is extended or adjusted under 35 U.S.C. 154(b) by 764 days.

(21) Appl. No.: 17/517,737

(22) Filed: Nov. 3, 2021

(65) Prior Publication Data

US 2022/0057105 A1 Feb. 24, 2022

Related U.S. Application Data

(63) Continuation-in-part of application No. 16/389,881, filed on Apr. 19, 2019, now Pat. No. 11,181,296.

(60) Provisional application No. 62/762,062, filed on Apr. 19, 2018.

(51) Int. Cl.
*F24F 13/08* (2006.01)

(52) U.S. Cl.
CPC ..... *F24F 13/084* (2013.01); *F24F 13/085* (2013.01)

(58) Field of Classification Search
CPC ..... F24F 13/00; F24F 13/08; F24F 13/082; F24F 13/084; F24F 13/085
See application file for complete search history.

(56) References Cited

U.S. PATENT DOCUMENTS 2,575,499 A 11/1951 Manow
2,825,500 A 3/1958 McLean
4,981,501 A 1/1991 Von Blucher
5,472,380 A * 12/1995 Sarazen, Jr. ..... F24F 13/085 454/324
5,525,145 A 6/1996 Hodge
5,720,660 A 2/1998 Benedetto et al.
5,776,218 A * 7/1998 Enns ..... B01D 46/0004 55/DIG. 35
8,460,419 B1 6/2013 Hobbs
9,726,395 B2 8/2017 Hammer
10,543,445 B2 1/2020 Branzelle et al.
2005/0161387 A1 7/2005 Van de Graaf et al.
2014/0373493 A1 12/2014 Cannon

OTHER PUBLICATIONS

"K Push Magnetic Catches" by Richelieu Hardware-HQ (Published Oct. 17, 2016) Accessible at: https://www.youtube.com/watch?FfLuZfAPfh8c (Year: 2016).*.

* cited by examiner

*Primary Examiner* — Natasha E Young
(74) *Attorney, Agent, or Firm* — Jacob M. Ward; Ward Law Office LLC

(57) ABSTRACT

A venting system includes a frame and a register cover attached to the frame. The register cover includes a plurality of alternating open areas and air diverting fins vertically orientated on the register cover. Three open areas among the plurality of open areas are disposed proximate a central portion of the register cover. A tool engagement feature is located at the central portion of the register cover and includes a plurality of concave surfaces formed on at least four of the air diverting fins among the plurality of air diverting fins. The tool engagement feature further includes a forwardly projecting knuckle arranged at a center of each of the three open areas disposed at the central portion of the register cover.

20 Claims, 10 Drawing Sheets

SYSTEM AND METHOD FOR IMPROVING AIR-QUALITY OF A SPACE SERVICED BY AN EXIT REGISTER

CROSS-REFERENCE TO RELATED APPLICATIONS

This application is a continuation-in-part of U.S. patent application Ser. No. 16/389,881, now U.S. Pat. No. 11,181,296, filed Apr. 19, 2019, which in turn claims the benefit of U.S. Provisional Application No. 62/762,062, filed on Apr. 19, 2018. The entire disclosures of the above applications are incorporated herein by reference.

FIELD

The present disclosure relates to air venting systems, and more particularly, to air venting system covers.

BACKGROUND

The statements in this section merely provide background information related to the present disclosure and may not constitute prior art.

Air forced through heating, ventilation, and air conditioning (HVAC) systems is generally ducted to one or more registers, vents or diffusers, which are located in predetermined locations throughout a residential and/or commercial buildings, such as a house, apartment, stores, and offices, among others. HVAC systems generally have a series of air passageways or ducts contained within the building's walls, floors, ceilings, and attic crawl spaces. The ducts carry heated or cooled air to registers located in various rooms of the building. The ducts may engage registers attached to the back side of an interior surface, such as sheetrock, a ceiling, a wallboard, a finished or un-finished surface, etc., at openings designed for the register. The register may attach to a wallboard by, for example, screws, nails, or anchors.

Typical centralized air heating and cooling systems use ducting to transport air to various rooms from a centrally located HVAC system. The heated or cooled air exits the ducts into various rooms in residential or commercial buildings through air vents. Air vents perform two main functions including directing air into the various rooms and to open and limit the airflow to a room. Central air HVAC systems are equipped with filters located at the main HVAC system. These filters may remove particles in the air. Some particles can still be present in the air and will exit into the room through the air vents. Typically, air that circulates through the HVAC ducting and blower systems may be filtered through the return air filter provision. The air filter provisions effectiveness, is determined by the type and quality of the filter used and the overall condition of the HVAC system and the associated ducting through which the air flows, along with the condition of the exit registers. And the condition of the overall environment the system is servicing whether it be a clean environment or perhaps a very dirty dusty environment. As a result of these many and varied conditions, the exit airflow from the exit vent registers is likely to be substantially contaminated or causing airborne particulate contamination, even if the return air filters are in place and are regularly maintained according to industry standards. Typical exit register covers with air filters to improve the air-quality of any given space serviced by the exit register have utility limitations or omissions that may hinder full and convenient optimization and functionality of the exit register cover.

Furthermore, typical HVAC air filters may be installed at return air grills or directly adjacent to the HVAC blower unit. The air is pulled into the HVAC system and then delivered through a series of air ducts to service each room in a building as designed. The initial intake air typically employs a filter. This air system circulates and conditions the air while the system is running. Within a HVAC blower ducting system, typically, there exists between 10 feet and 100 feet or more of air ducting that delivers the air to any given room or space. These ducting systems are usually concealed in attic spaces, walls, and/or ceiling void spaces before exiting into the given spaces the ducting provides air flow too. Unfortunately, these concealed ducting air passages overtime can get very dirty and contaminated with dust particles, living or dead biological material, mold, among other contaminants. In addition, the ducting blower systems may become compromised. For example, the intake air filter may not be installed properly. The intake air filter may not be replaced or cleaned as needed, and thus clog or contaminate the air conditioning. There may be unseen gaps in the ducting system that can significantly cause the air in the ducting system to become contaminated in route to the room exit points. These factors may play a role in adversely affecting the overall quality of air that is being circulated through the HVAC system. It is well known that poor indoor air quality can cause significant health risks and/or exacerbate existing health conditions.

Typical exit registers tend to blow the air in one general direction even though registers have adjustment louvers. Once the louvre position has been set, the exit air may take on a particular persistent pattern of airflow into any given space. This particular persistent pattern may kick up or stir up existing room dust from the floor and other surfaces, thereafter, may create a circular pattern that continuously circulates existing room airborne particulate contamination and particulate/biologic contamination emanating from the ducting system itself. If the spaces are not near the return air filter provision, the circular air patterns created by the HVAC exit air, may not receive any filtration. As a result, the circular pattern of air containing the particulate contamination may pose significant health risks for individuals who may be occupying or sleeping in those spaces. Children and the elderly in particular are at high risk. Persistent direct airflow, which is typical with conventional exit registers, can be harmful to humans, especially young children or elderly in sleeping spaces exposed to prolonged exposure. For example, air flow/dust circulation patterns from HVAC systems have caused development of asthma in children.

There is a continuing need to improve the air quality being circulated through HVAC systems.

SUMMARY

In concordance with the present disclosure, a register cover including a tool engagement feature for receiving a tool and air diverting fins, which permits a user to easily attach and detach the register cover to a frame and improves air quality being circulated through a HVAC system, is surprisingly discovered.

In one embodiment, a system includes a frame and a register cover attached to the frame, the register cover includes a plurality of alternating open areas and air diverting fins vertically orientated on the register cover, wherein the plurality of open areas includes three open areas disposed proximate a central portion of the register cover, and a tool engagement feature located at the central portion of the register cover, the tool engagement feature includes a plurality of concave surfaces formed on at least four of the air diverting fins among the plurality of air diverting fins, and a forwardly projecting knuckle arranged at a center of each of the three open areas disposed proximate the central portion of the register cover.

In one example, a height adjustable magnet is disposed proximate each corner of the register cover and configured to magnetically engage the frame. The height adjustable magnet may be wedge shaped.

In another example, the system further includes a filter disposed between the frame and the register cover.

In another example, half of the plurality of air diverting fins are pointed toward a left side of the register cover and half of the plurality of air diverting fins are pointed toward a right side of the register cover.

In another example, each forwardly projecting knuckle defines an insertion hole for receiving a tool.

In another embodiment, a system includes a register cover having a plurality of open areas and a tool engagement features. The plurality of open areas includes an open area disposed proximate a central portion of the register cover, and a plurality of air diverting fins arranged between adjacent open areas among the plurality of open areas, the plurality of air diverting fins including an air diverting fin disposed proximate the central portion of the register cover. The tool engagement feature horizontally extends along the central portion of the register cover and includes a concave surface and a forwardly projecting knuckle, wherein the air diverting fin is disposed proximate the central portion of the register cover defines the concave surface of the tool engagement feature, and the forwardly projecting knuckle is disposed at a center of the open area disposed proximate the central portion of the register cover.

In one example, the plurality of open areas and the plurality of air diverting fins are vertically orientated on the register cover.

In another example, the system further includes a frame and a height adjustable magnet disposed proximate each corner of the register cover, each height adjustable magnet being configured to magnetically engage the frame. A filter may be disposed between the frame and the register cover.

In another embodiment, a system includes a frame, a register cover attached to the frame, the register cover including a plurality of fins including horizontally orientated fins and vertically orientated fins, and a tool engagement feature extending along a central portion of the register cover, wherein the tool engagement feature includes a concave surface and a plurality of forwardly projecting knuckles.

In one example, the horizontally orientated fins are pivotably mounted to the register cover. The horizontally orientated fins may have a range of rotation of 180°.

In another example, the horizontally orientated fins are arranged above the tool engagement feature and the vertically orientated fins are disposed below the horizontally orientated fins.

In another example, the horizontally orientated fins are arranged below the tool engagement feature and the vertically orientated fins are disposed above the horizontally orientated fins.

In another example, the vertically orientated fins include right side vertically orientated fins pointed to a right side of the register cover, left side vertically orientated fins pointed to a left side of the register cover, and midpoint vertically orientated fins arranged between the right side vertically orientated fins and the left side vertically orientated fins. The midpoint vertically orientated fins may define a length that is less than a length of the right side vertically orientated fins and the left side vertically orientated fins.

In other examples, the system further includes a frame and a height adjustable magnet disposed proximate each corner of the register cover, the height adjustable magnet configured to magnetically engage the frame. The height adjustable magnet may be wedge shaped. The system may include a filter disposed between the frame and the register cover.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
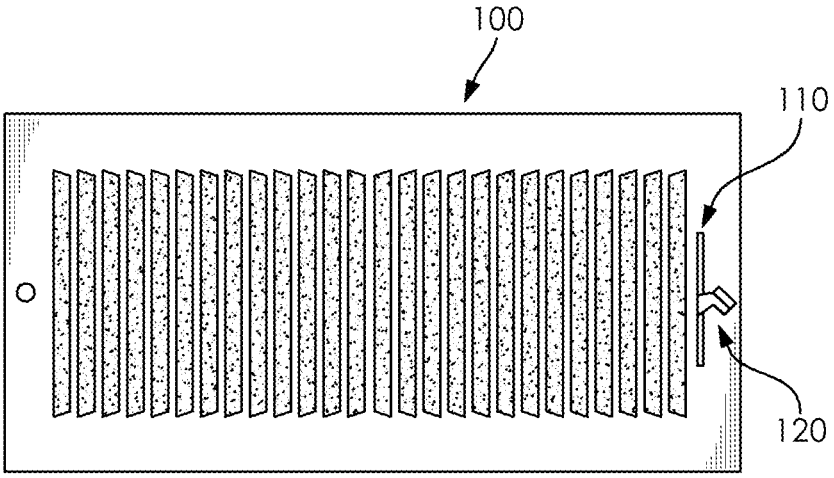
FIG. 1 (PRIOR ART)
FIGS. 1-3 illustrate a register vent cover according to the prior art.

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed.

The terms "a" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. The term "about" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter can define endpoints for a range of values that can be claimed for the parameter. For example, if Parameter X is exemplified herein to have value A and also exemplified to have value Z, it is envisioned that Parameter X can have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X can have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it can be directly on, engaged, connected, or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Figure 2:
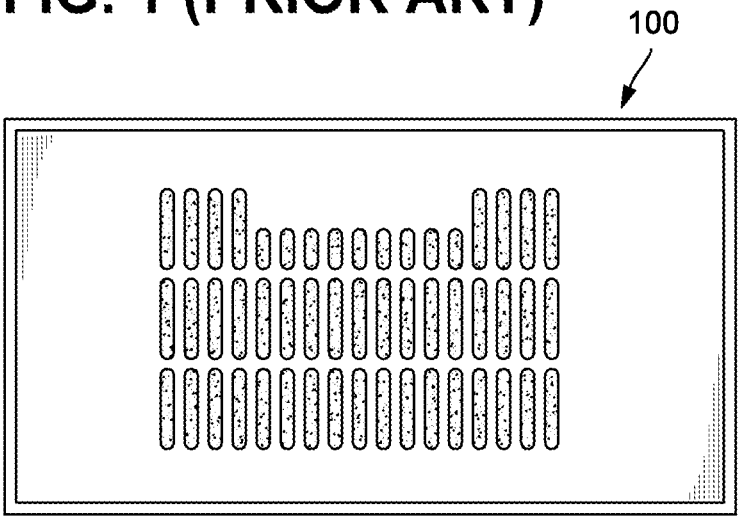
FIG. 2 (PRIOR ART)
Figure 3:
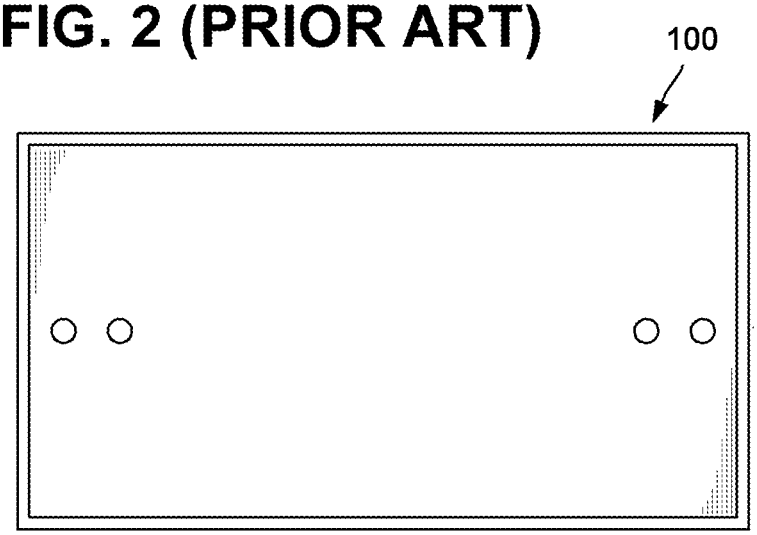
FIG. 3 (PRIOR ART)

FIGS. 1-3 illustrate a register cover 100 according to the prior art. The register cover includes a louver arm 120 and a louver arm slot 110.

The present disclosure provides an air venting system including a register, grille, or vent cover device and a secondary air filtration implement. The system may be installed as retrofit over existing registers or to install as a replacement or new construction at a ducting air exit point. The air venting system may further comprise a blank open metal frame, which may be fastened with approximately two screws. In one non-limiting example, the blank open metal frame may include a rectangle or square metal frame with approximately ⅛" turned over sides, inside and out, and securely fastened with two screws to a wall or floor surface over an exit ducting plenum. Once the frame is installed it becomes the new open metal base by which a new magnetic register/grille cover and/or secondary air filtration may be installed by magnetic force on top of the new metal frame.

The register cover with filter appliance may comprise a plastic or metal register cover having grills arranged with a series of fins that are approximately half inch (½") wide, between half inch (½") open areas. The fins may be roughly equally separated from a middle open area and are generally angled away from each other at a more or less thirty degrees (30°) plane. The register cover with the fins may provide increased airflow while supporting and containing the filter appliance. The register cover may further include adjustable magnets disposed proximate four (4) corners of the register cover at about three fourth inch (¾") from an end portion of each corner. The adjustable magnets may comprise of one or more magnets disposed at the end portion of each corner. The register cover may stand at about three fourth (¾") of an inch high. The length and width of the register cover may vary according to the length and width of the exit plenums they will be attached to, as the industry standard has many size openings. On the backside of the register cover, the filter appliance including a particulate filter may be installed inside from wall to wall. The particulate filter may be about three eighth inch (⅜") high and may have pre-existing cut out holes of about half inch (½") in diameter to be placed over the one or more magnet holders. The number of magnets and magnet holders may vary. In one example, if there are four (4) adjustable magnet holders on each corner of the register/grille/vent cover, the filter appliance may comprise four (4) pre-cut holes corresponding to the placement of the adjustable magnet. If there are six (6) adjustable magnet holders on each corner and at a proximate middle portion of the register cover, the filter appliance may comprise six (6) pre-cut holes corresponding to the placement of the adjustable magnet.

The new metal base frame may be used over existing aluminum registers and become the base for the retrofit new register cover and/or filter appliance. For example, aluminum registers are used at times in areas subject to moisture.

The adjustable magnets have height adjustment capabilities. The magnets are installed into plastic stud holes that generally allow the magnets to move up and down inside the plastic stud holes, while at the same time have enough friction.

In one example, in order to use the register cover with filter appliance over existing registers, the new register cover with filter appliance may be designed to accommodate typical louver adjustment arm. The louver adjustment arms may typically extend out from the plane of the existing register by about one and a half inch (1½"), and the louver adjustment arms may be found at varying areas depending on the type and age of the existing register. The register cover may have half inch (½") open areas between the half inch (½") air diverting fins. The half inch (½") open areas are large enough and spaced enough to accommodate louver adjustment arms that may be purchased new or appear on older register appliances. The open area access points allow the existing register to be adjusted via the louver handle. For example, the filter appliance may have to be cut at the location of the louver arm to pass though or have factory precuts.

To reduce circular air patterns and limit existing room dust from becoming airborne, air exiting from the register will first be filtered through the filter media. This first step will soften and balance out the register exit air. The air will then pass through the register cover/grill. As previously described, the grill may have half inch (½") open spaces, half inch (½") air diverting fins, and thirty degrees (30°) disbursal fins that alternate between the open spaces. The dispersal fins may be separated in the middle of the register cover, where half may divert air to the right and half may divert air to the left. The fins improve, soften, and disburses the air entering the room where the new system is installed. And thus, may reduce the potential for associated persistent air pattern circulation issues. Further, the left and right side of the register cover comprises one or more indentations configured as filter holding areas which may make installing or removing the filter appliance much easier.

The register cover or filter frame may further comprise a removable scented pad which may impart an aroma or therapeutic fragrance to the air blowing through the register. Additionally, the filter appliance may incorporate an anti-bacterial filter media, allergy-free filter media, and/or odor reduction filter media.

The register/grille/vent cover and filter appliance engage with the existing register quickly through the use of the adjustable magnets. The register cover may be made from a metal material. Alternatively, the register cover may be made from a plastic material, which may be molded from a plastic composite material, such as, but not limited to, PVC, ABS, etc. The register cover may be square, rectangular, spherical and/or quadrilateral shaped having a top, a bottom and four (4) sidewalls that may cover a register. Alternatively, the register cover may be shaped and sized to accommodate varying shapes and sizes of existing register/grille/vent covers. When placed over a register, the bottom end portion of the sides of the register cover come in contact with the surface of a floor, a wallboard, a ceiling, or other finished or un-finished surface, that surrounds the register. The register cover may form a tight and flush seal over the register, which may inhibit the transfer of air from leaving and/or entering the register. The register cover is attached to the register through the one or more securing magnetic elements that may form a magnetic attraction between the register cover and the register.

The register cover may include dampers to control the flow of air through the register. The register cover may be provided with a plurality of closely spaced louvers that are controlled by an external lever to adjust the louvers in an open position, a closed position or a position that is set by the user. In the closed position, the damper permits the louvers to closely overlap each other to impede the flow of air through the air register. In the closed position, heated or cooled air circulated by the HVAC system may be redirected to another portion of a residential or commercial building.

Figure 4:
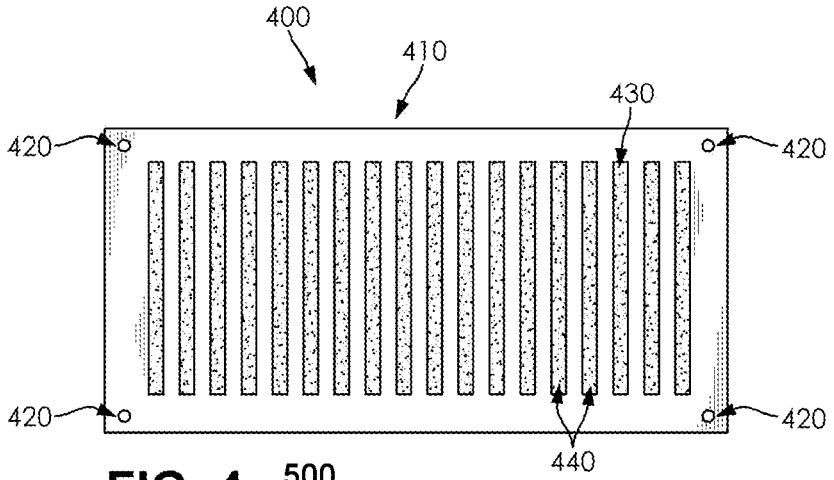
FIG. 4 is a front plan view of a venting system with a register cover in accordance with the present disclosure.

FIG. 4 is an illustration of a venting system 400 with a register cover device 410 in accordance with one embodiment of the present disclosure. The register cover device 410 includes a plurality of height adjustable magnet implements 420, a plurality of alternating open spaces with air diverting fins, and a plurality of louver handle slots 440 configured to accommodate louver handles. The height adjustable magnet implement 420 may comprise at least one of a cylindrical shaped magnet, a round shaped magnet, a square shaped magnet, or a rectangular shaped magnet. The height adjustable magnet implement 420 may further comprise at least four (4) height adjustable magnets, each height adjustable magnet being disposed at an end portion of a corner of the register cover device. The height adjustable magnets 420 may be installed into plastic stud holes that allow the height adjustable magnets 420 to move up and down inside the plastic stud holes, while having enough friction. The height adjustable magnets 420 allow the register cover to be retrofit over existing vent registers of varying heights. Some existing register covers are as thin as about 1/16" or as thick as about ¼. Thus, in order for the register cover and filter appliance to encompass the old register or the new open metal frame, the magnets may be able to substantially adjust to those variations in height to achieve as close to airtight as possible, and for direct magnet to metal contact attachment. As such, when the system is installed properly, the system may provide for the ability to filter, soften, and disperse the air coming out of the exit register where the register cover and filter appliance is installed. The system provides for easy replacement and/or cleaning of the filter appliance and/or register cover. Further, the system provides easy access to the plenum ducting system for cleaning and inspection. Once the register cover device 410 has been installed and positioned, the register cover device 410 will meet flush against the adjoining wall or floor, and to either the existing register or new metal frame base. The height adjustable magnets 420 may thereafter stay in place tight, as a custom fit appliance.

The alternating open spaces 430 with air diverting fins may comprise about half inch (½") open spaces. The air diverting fins may comprise of roughly half inch (½") width and about thirty (30) degrees incline air diverting fins.

In some embodiments, the register cover may be made from a plastic material, which may be molded from a composite material, such as, but not limited to, PVC, ABS, urethane resin, etc. Alternatively, the register cover device 410 may be made from a metal material including but not limited to, aluminum, steel, etc. Further, the length and width of the register cover device 410 may vary to match existing duct opening.

Figure 5:
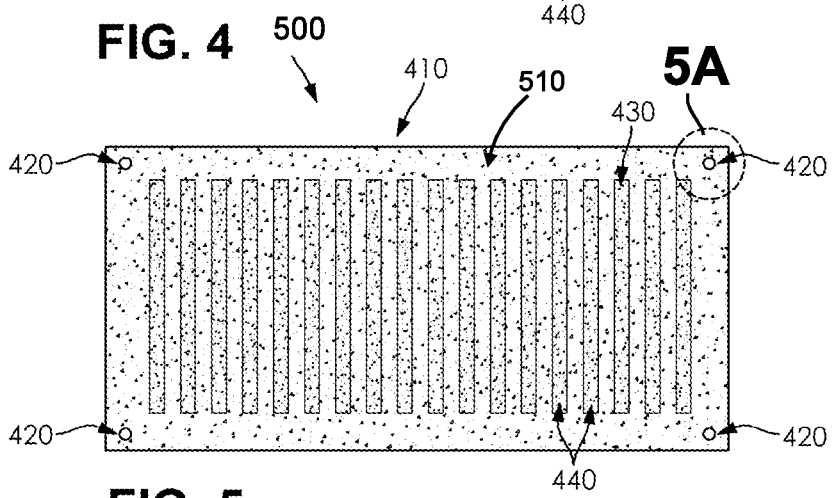
FIG. 5 is back plan view of a venting system with a register cover according to the present disclosure.
Figure 5A:
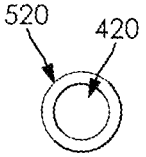
FIG. 5A is a close-up view of a pre-cut hole taken from cutout 5A of FIG. 5.

FIG. 5 is a back view illustration 500 of the exemplary register cover device 410, in accordance with an embodiment of the present disclosure. In the present embodiment shown, the back portion of the register cover device 410 comprises at least one or more indentations 530. The one or more indented areas are configured as filter appliance 510 holding areas which may make installing or removing the filter appliance 510 much easier. The filter appliance 510 mostly covers a wall-to-wall back side portion of the register cover device 410. The filter appliance 510 may comprise a plurality of pre-cut holes 520 corresponding to the placement of the height adjustable magnet 420 on the register cover device 410. For example, if there are about four (4) adjustable magnet holders on each corner of the register cover, the filter appliance 510 may comprise roughly four (4) pre-cut holes corresponding to the placement of the adjustable magnet. If there are about six (6) adjustable magnet holders on each corner and proximate a middle portion of the register cover, the filter appliance 510 may comprise six (6) pre-cut holes corresponding to the placement of the adjustable magnet. FIG. 5A shows an exploded top view of a pre-cut hole 520 corresponding to a height adjustable magnet 420.

In additional embodiments, the filter appliance 510 may comprise a removable filter frame. The filter frame housing a filter medium is receivable in one or more indentations or filter holding areas of the register cover. The filter holding areas may comprise of securing elements such as, but not limited to Velcro®, snaps, buttons, adhesive, etc. to secure the filter frame. The filter frame may comprise a plurality of pre-cut holes 520 corresponding to the number of height adjustable magnet 420 holders on the register cover device 410. The filter frame may further comprise one or more filter frames corresponding to the number of indentations or filter holding areas. The filter frame may include multiple entry and exit openings for filtered air to pass though. The filter holding areas may comprise a channel opening formed within the sidewalls of the register cover wherein the filter frame is receivable and removable through the channel. The filter holding areas may further comprise securing elements such as, but not limited to Velcro®, snaps, buttons, adhesive, etc. to secure the filter frame.

In some embodiments, the register cover or filter frame may further comprise a removable scented pad which may impart an aroma or therapeutic fragrance to the air blowing through the register. Additionally, the filter appliance 510 may incorporate activated carbon filters configured to chemically absorb contaminants, impurities, and light odors from the air. In one example, the filter appliance 510 includes an antibacterial filter media configured to inhibit the growth of microorganisms while substantially ridding the air of, for example, mold and mildew. In another example, the filter appliance 510 includes an allergy-free filter media configured to capture dust, lint, smoke, mold, mildew and pollen, among other allergy pathogens. In yet another example, the filter appliance 510 includes an odor reduction filter media.

Figure 6:
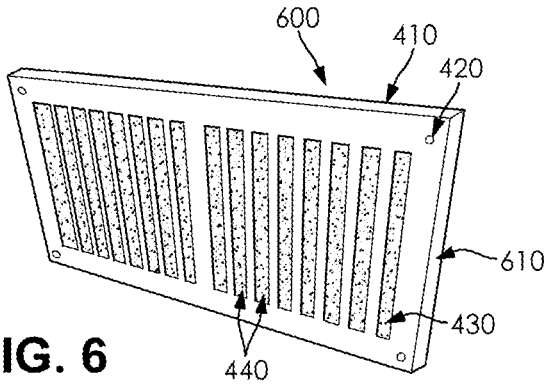
FIG. 6 is a front perspective view of a venting system with a register cover according to the present disclosure.

FIG. 6 is a perspective view of an exemplary register cover device 410 in accordance with an embodiment of the present disclosure. In the embodiment shown, the register cover device 410 comprises a height adjustable magnet implement 420, a plurality of alternating open spaces 430 with air diverting fins, a louver handle slot 440 to accommodate an existing louver handle, and a device sidewall 610. The device sidewall 610 may define a height of about three fourths inch (¾"). The height adjustable magnet implement 420 may comprise at least one of, a cylindrical, round, square or rectangular shaped magnet. The height adjustable magnets may further comprise about one fourth by one half inch (¼"×½") height adjustable magnets. The height adjustable magnet implement 420 may further comprise at least four (4) height adjustable magnets, each height adjustable magnet being disposed on an end portion of a corner of the register cover device 410. The height adjustable magnets may be disposed three-fourth by three-fourth inch (¾"×¾") from an end portion of the corner of the device. The alternating open space and/or fins may be at a thirty (30) degrees incline. In one embodiment, roughly half of the fins may be generally pointed to a left side and half of the fins may be pointed to a right side of the register cover device.

Figure 7A:
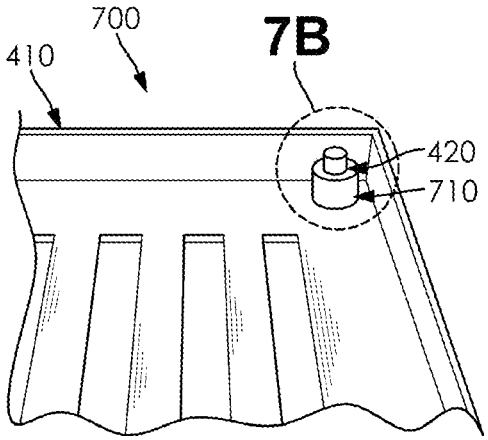
FIG. 7A is a partial back view of a venting system with a register cover depicting an adjustable magnet disposed in a magnet holder according to the present disclosure.
Figure 7B:
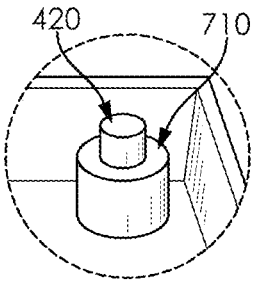
FIG. 7B is a close-up view of the adjustable magnet and magnet holder of FIG. 7A.

FIG. 7A is a back corner view 700 of the register cover device 410, in accordance with an embodiment of the present disclosure. In the embodiment shown, the register cover device 410 includes a height adjustable magnet implement 420 installed into a magnet holder 710. The height adjustable magnet implement 420 may be a cylindrical shaped magnet. Alternatively, the height adjustable magnet implement 420 may be square shaped, rectangle shaped, or triangle shaped. The height adjustable magnet may include a magnet with five (5) or more sides and/or a magnet with wavy sides. The height adjustable magnet implement 420 may be disposed on an end portion of a corner of the register cover device. The height adjustable magnet implement 420 may be installed into a magnet holder 710 that is configured to allow the height adjustable magnet implement 420 to move up and down inside the magnet holder 710, but at the same time have enough friction. For example, magnet holder 710 may be fitted over height adjustable magnet implement 420 to provide for up and down movement to achieve height adjustment while at the same time applying enough friction to hold the height adjustable magnet implement 420 tight, once proper height adjustment is achieved. In additional embodiments, height adjustable magnet implement 420 height adjustment may be achieved by other mechanical means such as, but not limited, magnet holder with screw head. FIG. 7B shows an exploded top view of a magnet holder 710 with a corresponding height adjustable magnet 420.

Figure 8:
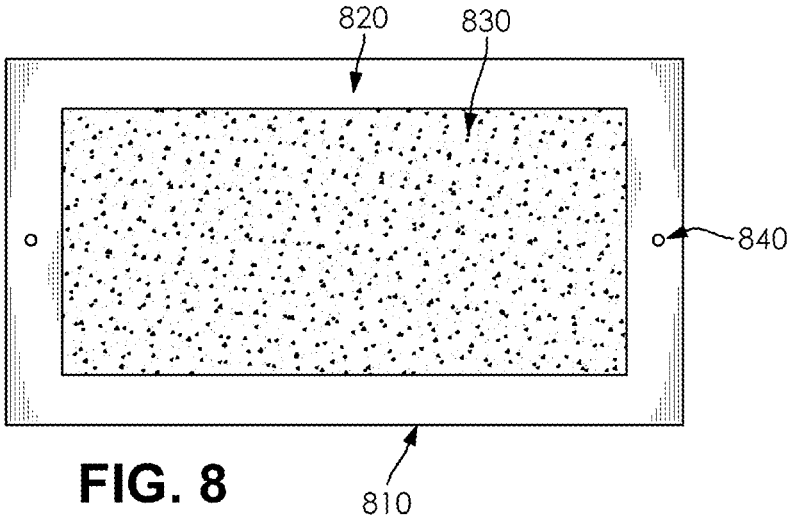
FIG. 8 is a back view of a venting system with a register cover according to the present disclosure.

FIG. 8 is an illustration of an exemplary register cover base frame 810, in accordance with the present disclosure. As shown, the register cover base frame 810 comprises a metal base 820, a blank or base frame open space 830 to ducting plenum, and a base frame securing holes 840. The register cover base frame 810 dimensions may include 1¼×1¼×⅛. The system may be installed as retrofit, as a replacement, or in newly constructed systems. Existing covers of ducting systems such as air vents, grilles, and air registers get dirty and may compel cleaning regularly. In order to clean the ducting systems, an existing air register/grille/vent cover may have to be taken out to access the plenum/ducting behind the existing air register/grille/vent cover. This entails the air register/grille/vent cover to be removed, typically by removing the two register fastening screws. However, it may be difficult and problematic, as existing air register/grille/vent covers may be in difficult to reach areas or there may be many layers of paint over the existing registers essentially gluing or affixing the register to the surface, thereby inhibiting removal of the register cover. Inhibiting removal of the registers obstructs the ability to clean, maintain, and/or inspect the ducting system or the register/grille covers. As a result, high levels of dust and other contaminations accumulates over time. Installing the metal open frame in place of the existing registers/grilles, provides for easy, instant access to the interior ducting system for cleaning, maintenance, and/or inspection as recommended. This may be accomplished by simply lifting off magnetically attached register/grille cover and/or filter appliance without having to unscrew any securing means. By removing the existing register and replacing it with the new register/grille cover and/or filter appliance as replacement or new construction, the system may provide for ease of maintenance, better overall performance and longevity of the HVAC system. Also, by removing old existing register cover and installing new appliance consisting of open frame, filter medium and magnetically attached cover, one register is eliminated, resulting in less back pressure to the HVAC system and thus greater airflow through the new appliance and filter medium.

Figure 9:
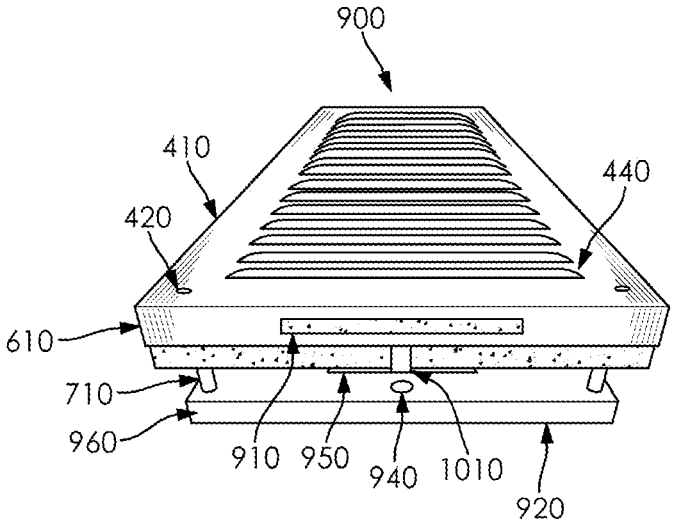
FIG. 9 is a side perspective view of a venting system according to the present disclosure.

FIG. 9 is an illustration of a venting system 900, in accordance with the present disclosure. The venting system 900 comprises a register cover device 410 installed over an existing register 920. The register cover device 410 shown may comprise a height adjustable magnet implement 420 disposed on an end portion of a corner of the register cover device, a sidewall 610 surrounding the device, an upper louver handle slot 440 to accommodate existing louver handles, and an indented handle 910 for generally handling the device. The indented handle 910 may include a rubberized grip. The register cover device 410 magnetically attaches to the existing register 920 via the height adjustable magnet implement 420 housed in a magnet holder 710. The existing register 920 having a thickness 960 may be installed on a surface with screws through securing holes 940. The upper louver handle slot 440 is configured to accommodate the upper portion of louver arm 930 of the existing register 920 and allow the lower portion of louver arm 930 to travel through lower louver arm slot 950.

Figure 10:
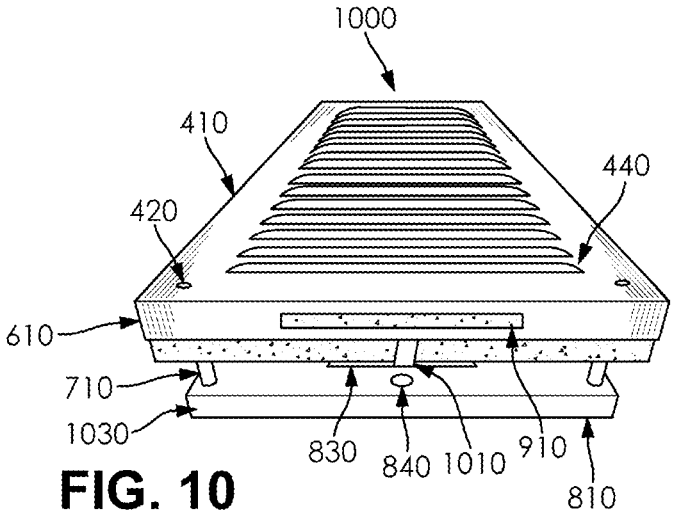
FIG. 10 is a side perspective view of a venting system according to the present disclosure.

FIG. 10 is an illustration of a venting system 1000, in accordance with the present disclosure. The venting system 1000 comprise a register cover device 410 installed over a newly installed metal frame base 810. The register cover device 410 shown may comprise a height adjustable magnet implement 420 disposed on an end portion of a corner of the register cover device, a sidewall 610 surrounding the device, and an indented handle 910 for generally handling the device. The indented handle 910 may include a rubberized grip. The register cover device 410 magnetically attaches to the metal frame base 810 via the height adjustable magnet implement 420 housed in a magnet holder 710. The metal frame base 810 having a thickness 1030 may be installed on a surface with screws through the base frame securing holes 840. The metal frame base 810 may allow a louver arm 1010 through a base frame open space 830. The louver handle slot 440 is configured to accommodate the louver arm 1010 and allow the louver arm 1010 to travel the base frame open space 830.

Figure 11:
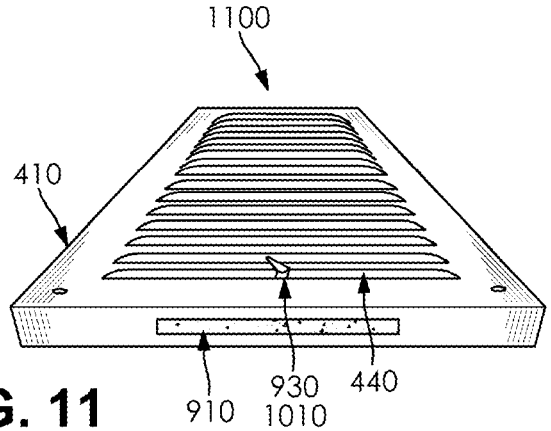
FIG. 11 is a side perspective view of a venting system illustrating a register cover installed over a register base according to the present disclosure.

FIG. 11 illustrates an installed exemplary register cover device installed over an existing register, in accordance with the present disclosure. The register cover device 410 having an indented handle 910 may be installed over an existing register 920 or over a metal frame base 810. The louver arm 930 1010 may be accommodated through the louver handle slot 440.

Figure 12:
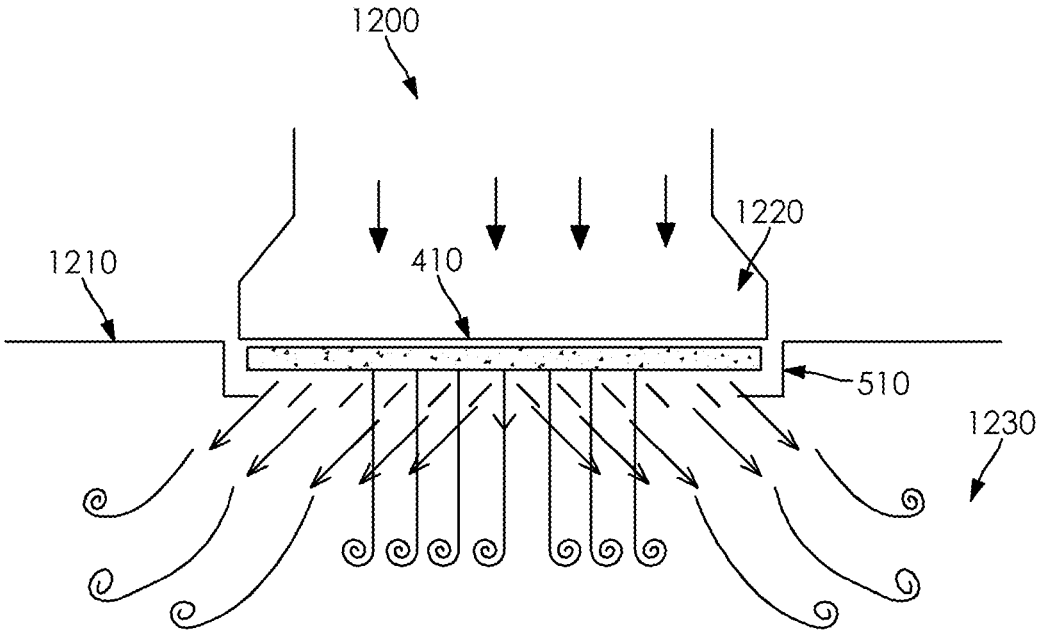
FIG. 12 is a cross-sectional side view of a venting system illustrating air passing through according to the present disclosure.

FIG. 12 is an illustration 1200 of an exemplary filtered air through the venting system, in accordance with the present disclosure. An air flow 1220 from a ducting system passes through the register cover device 410 and filtered with the filter appliance 510. When the system is installed, the system may provide for the ability to filter, soften, and disperse the filtered air 1230 coming out of the exit register where the register cover device 410 and filter appliance 510 is installed, such as a surface 1210. The filtered air 1230 may be dispersed downward and sideways in a safer and more efficient manner than standard industry registers.

Figure 13:
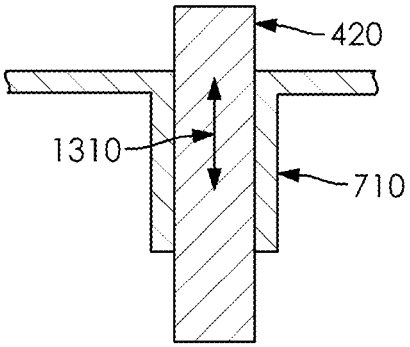
FIG. 13 is a cross-sectional view side view of an adjustable magnet and magnet holder according to the present disclosure.

FIG. 13 is a close-up illustration of a magnet holder 710, the magnet holder 710 includes an inner portion with an inner surface and an outer portion with an outer surface that is fitted over height adjustable magnet implement 420 to provide for up and down movement to achieve height 1310 adjustment while at the same time applying enough friction to hold height adjustable magnet implement 420 tight, once proper height 1310 adjustment is achieved. The magnet holder may be made of plastic or other material with a round or square hole in which a round or square magnet may be inserted with the ability to move the magnet up or down in the hole while having enough hole precision or friction to sufficiently hold the magnet into a fixed position once precision height adjustment has been achieved. Magnet height adjustment will require some force initially to fine tune height adjustment. But once proper height is achieved regular on/off action of filter cover for filter changing, clean or maintenance will not change magnet height thereafter unless additional force is exerting.

Figure 14:
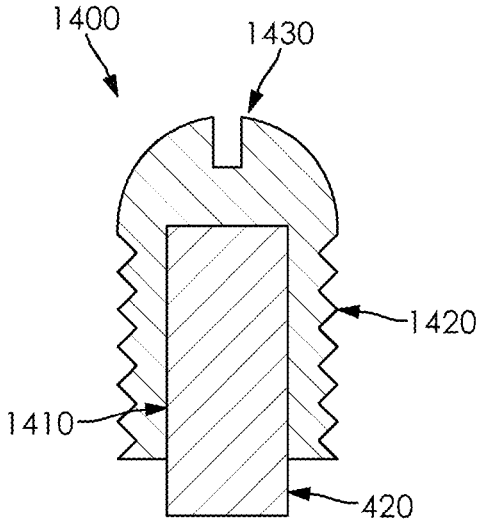
FIG. 14 is a cross-sectional view of a magnet holder according to the present disclosure.

FIG. 14 is an illustration of a magnet holder 1400 with screw cap/head, according to another embodiment of the present disclosure. The height adjustable magnet implement 420 height adjustment may be achieved by magnet holder 1400 with a screw body 1420, a screw cap/head 1430 and a hollow body 1410. Hollow body 1410 may comprise an outer portion with an outer surface and an inner portion with an inner surface. The shape of the inner portion may be round, square, rectangular, or triangular shaped, or a have five (5) or more sides that conform to the type of magnet implement used. The inner surface may be rough, wavy, or smooth and configured for gripping the magnet implement, while also allowing the magnet implement to be height adjusted. The outer portion may include rough outer surface shaped like screw that may be screwed on pre-cut holes 520 of the register cover device 410. Alternatively, the outer portion may comprise a smooth outer surface that may slide through pre-cut holes 520 of the register cover device 410. The screw head cap housing the magnet may adjust the height of the magnet by screwing the cap up and down, thus effectively adjusting the magnet height.

Figure 15:
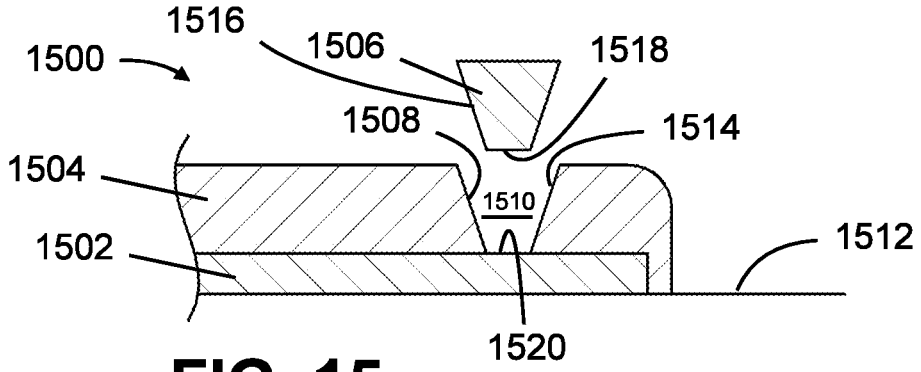
FIG. 15 is a partial cross-sectional side view of an adjustable magnet and magnet holder according to another embodiment of the present disclosure.

FIG. 15 is a partial cross-sectional side view of a venting system 1500 according to another embodiment of the present disclosure. The venting system 1500 includes a frame 1502, a register cover 1504 configured to fit over the frame 1502, and a height adjustable magnet 1506 disposed proximate each corner of the register cover 1504. The register cover 1504 includes air diverting fins and a magnet holder 1508 disposed proximate each corner of the register cover 1504 for receiving the height adjustable magnet 1506. The magnet holder 1508 is defined by an aperture 1510. When the height adjustable magnet 1506 is installed into the magnet holder 1508, the height adjustable magnet 1506 is in frictional contact with the magnet holder 1508 and movable within the magnet holder 1508 to adjust a height of the height adjustable magnet 1506 relative to the register cover 1504, and the height adjustable magnet 1506 is tightly held by the magnet holder 1508 once a selected height is achieved such that the height adjustable magnet 1506 is in direct contact with the frame 1502. Once the register cover 1504 has been installed and positioned on the frame 1502, each height adjustable magnet 1506 magnetically engages the frame 1502 such that the register cover 1504 is flush against the frame 1502 and an adjacent wall 1512 in which the frame 1502 is attached.

In one example, as shown in FIG. 15, the magnet holder 1508 and the height adjustable magnet 1506 are wedge shaped, wherein inner surfaces 1514 of the magnet holder 1508 engage with outer surfaces 1516 of the height adjustable magnet 1506 when the height adjustable magnet 1506 is installed in the magnet holder 1508. The height adjustable magnet 1506 includes a bottom surface 1518 configured to be in mating contact with a top surface 1520 of the frame 1502 when the register cover 1504 is installed and positioned on the frame 1502 thereby holding the register cover 1504 in place on the frame 1502 via magnetic force. The height adjustable magnet 1506 is configured to be self-locking. The height adjustable magnet 1506 may get tighter over time thereby increasing friction between the height adjustable magnet 1506 and magnet holder 1508. As such, the height adjustable magnet 1506 is not adversely affected by hot and cold cycles of HVAC systems.

The venting system 1500 may further include a filter disposed between the frame 1502 and the register cover 1504.

Figure 16:
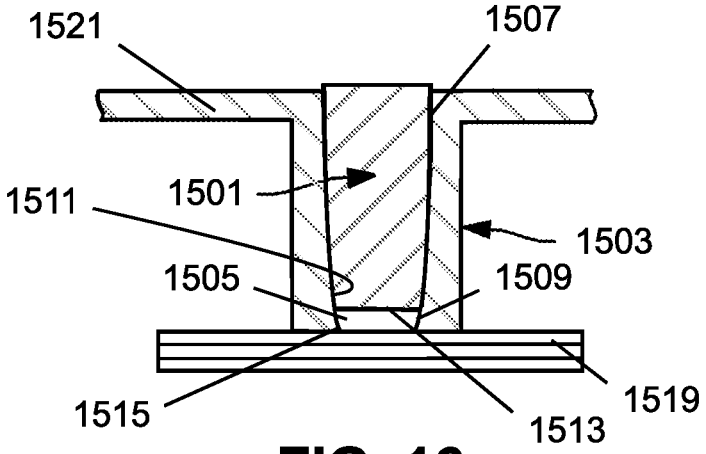
FIG. 16 is a cross-sectional view side view of a magnet and magnet holder according to the present disclosure.

FIG. 16 is a close-up cross-sectional side view of a magnet 1501 installed in a magnet holder 1503 disposed proximate a corner of a register cover 1521 attached to a frame 1519. In one example, the magnet 1501 has a cylindrical shape. The magnet holder 1503 can be made of plastic having a cylindrical hole 1505 corresponding to the cylindrical shape of the magnet 1501. The cylindrical hole 1505 includes a top portion 1507, a bottom portion 1509, and a cylindrical sidewall 1511 extending from the top portion 1507 to the bottom portion 1509. The top portion 1507 is configured to receive a bottom end 1513 of the magnet 1501. The bottom portion 1509 of the cylindrical sidewall 1511 tapers inward forming a lip 1515. The lip 1515 is configured to stop the magnet 1501 from passing through the bottom portion 1509 of the cylindrical hole 1505. During installation, force is applied to the magnet 1501 to push the magnet 1501 into the magnet holder 1503 until the bottom end 1513 of the magnet 1501 engages with the lip 1515 of the cylindrical sidewall 1511. The magnet 1501 is held in the magnet holder 1503 via friction fit.

In one example, a space 1517 is formed between the magnet 1501 and the frame 1519. However, the magnet 1501 is installed in the magnet holder 1503 close enough to the frame 1519 to magnetize and attach the register cover 1521 to the frame 1519. Over time, the expansion and contraction of the plastic register cover 1521 in combination with the magnetic force pulling the magnet 1501 toward the frame 1519 causes the magnet 1501 to move further in the magnet holder 1503 thereby decreasing the space 1517 and increasing the tightness of the fit between the magnet 1501 and magnet holder 1503.

Figure 17:
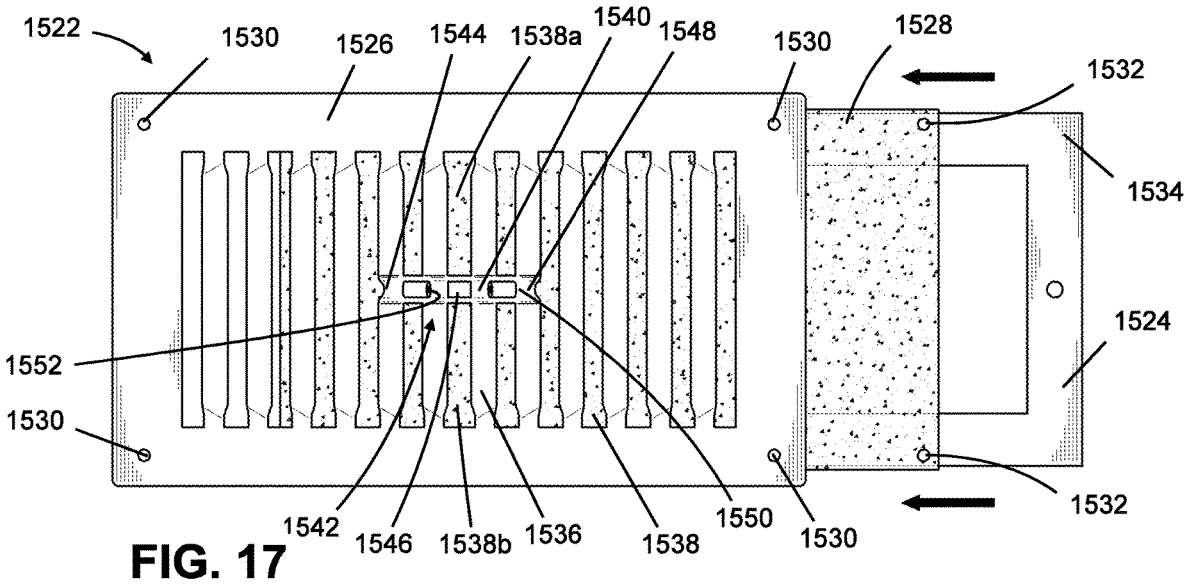
FIG. 17 is a front plan view of a venting system including a register cover according to another embodiment of the present disclosure.
Figure 18:
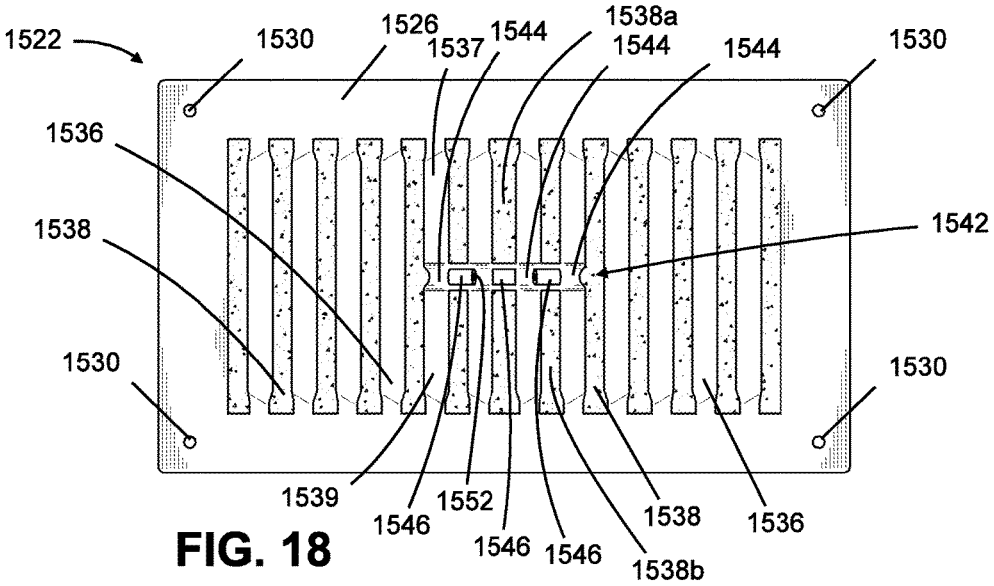
FIG. 18 is a front perspective view of the register cover of FIG. 17.

Referring to FIGS. 17-18, a venting system 1522, according to another embodiment of the present disclosure, includes a frame 1524, a register cover 1526 configured to fit over the frame 1524, a filter 1528 disposed between the frame 1524 and register cover 1526, and a height adjustable magnet 1530 disposed proximate each corner of the register cover 1526. The filter 1528 may include pre-cut holes 1532 at a location corresponding to the location of each height adjustable magnet 1530 to allow the height adjustable magnet 1530 to pass through the filter 1528 and make contact with an upper surface 1534 of the frame 1524.

The register cover 1526 includes a plurality of open areas 1538 and a plurality of air diverting fins 1536 disposed between adjacent open areas 1538 among the plurality of open areas 1538. In one example, the plurality of air diverting fins 1536 and adjacent open areas 1538 are vertically arranged on the register cover 1526. The air diverting fins 1536 are configured to improve, soften, and disburse air entering the room through the open areas 1538 where the venting system 1522 is installed. In one example, half of the air diverting fins 1536 may be generally pointed toward a left side of the register cover 1526 to divert the air to the left and half of the air diverting fins 1536 may be pointed toward a right side of the register cover 1526 to divert the air to the right.

As shown in FIGS. 17-18, the register cover 1526 includes a tool engagement feature 1540 operable to receive a tool 1554. The tool engagement feature 1540 allows the user to easily install and remove the register cover 1526 from the frame 1524. The tool engagement feature 1540 is located at a central portion 1542 of the register cover 1526. The tool engagement feature 1540 includes a concave surface 1544 and a forwardly projecting knuckle 1546 defining an insertion hole 1552 for receiving a tool 1554. The insertion hole 1552 of the forwardly projecting knuckle 1546 may define a circular shape. The concave surface 1544 is configured to facilitate engagement of the tool 1554 with the insertion hole 1552.

In one example, the plurality of open areas 1538 includes an open area 1538 disposed proximate the central portion 1542 of the register cover 1526 and the plurality of air diverting fins 1536 includes an air diverting fin 1536 disposed proximate the central portion 1542 of the register cover 1526. The forwardly projecting knuckle 1546 may be disposed proximate a center 1550 of the open area 1538 disposed proximate the central portion 1542 of the register cover 1526. The air diverting fin 1536 disposed proximate the central portion 1542 of the register cover 1526 may define the concave surface 1544 of the tool engagement feature 1540.

In another example, the tool engagement feature 1540 includes a plurality of concave surfaces 1544 and a plurality of forwardly projecting knuckles 1546 forming insertion holes 1552 for receiving a tool 1554. The insertion holes 1552 of each forwardly projecting knuckle 1546 may define a circular shape. The circular shaped insertion holes 1552 and concave surfaces 1544 form a path for receiving a cylindrical tool.

The tool engagement feature 1540 extends horizontally across air diverting fins 1536 and open areas 1538 located at the central portion 1542 of the register cover 1526. For example, the tool engagement feature 1540 may extend across at least two open areas 1538 and at least two air diverting fins 1536 disposed proximate the central portion 1542 of the register cover 1526. In one specific example, as shown in FIGS. 17-18, the tool engagement feature 1540 extends across at least four central air diverting fins 1536 and at least three central open areas 1538. Each of the four air diverting fins 1536 defines one of the concave surfaces 1544 among the plurality of concave surfaces 1544. The concave surfaces 1544 may be located at a center 1548 of each of the four air diverting fins 1536. In other words, each of the four air diverting fins 1536 defines a concave surface 1544 between an upper portion 1537 and a lower portion 1539 of the air diverting fin 1536.

One of the forwardly projecting knuckles 1546 among the plurality of forwardly projecting knuckles 1546 is formed at a center 1550 of each of the three open areas 1538. The three open areas 1538 are split by the forwardly projecting knuckles 1546 thereby forming three upper open areas 1538*a* and three lower open areas 1538*b*. As such, in this example, the tool engagement feature 1540 includes four concave surfaces 1544 and three forwardly projecting knuckles 1546.

It should be appreciated that while the tool engagement feature 1540 is shown extending across four air diverting fins 1536 and three open areas 1538, one skilled in the art can scale the location and number of air diverting fins 1536 and open areas 1538 the tool engagement feature 1540 extends, as desired.

Figure 19:
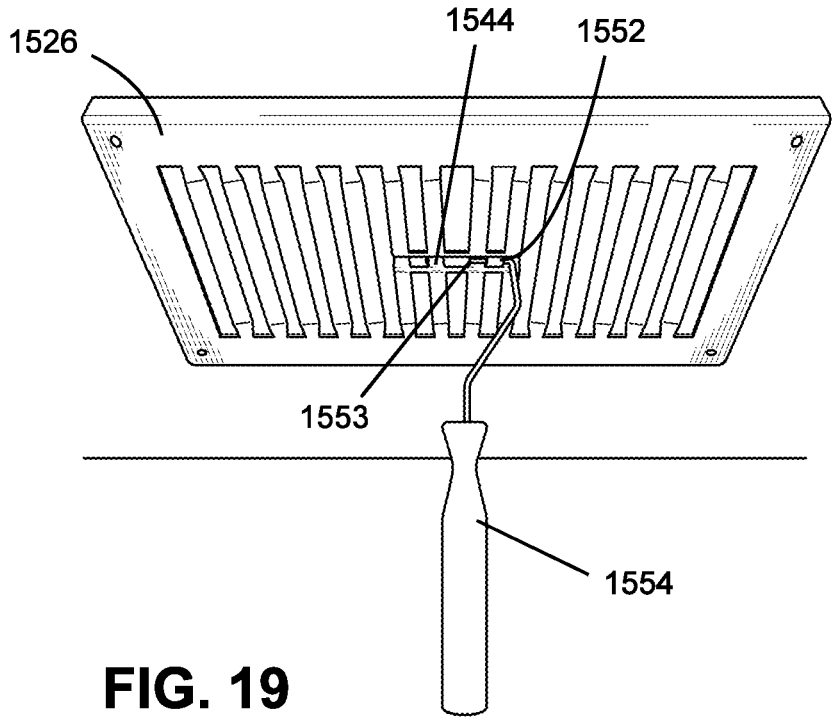
FIG. 19 is a front perspective view of the register cover of FIG. 17, depicting a tool inserted into insertion holes for removing the register cover according to the present disclosure.
Figure 20:
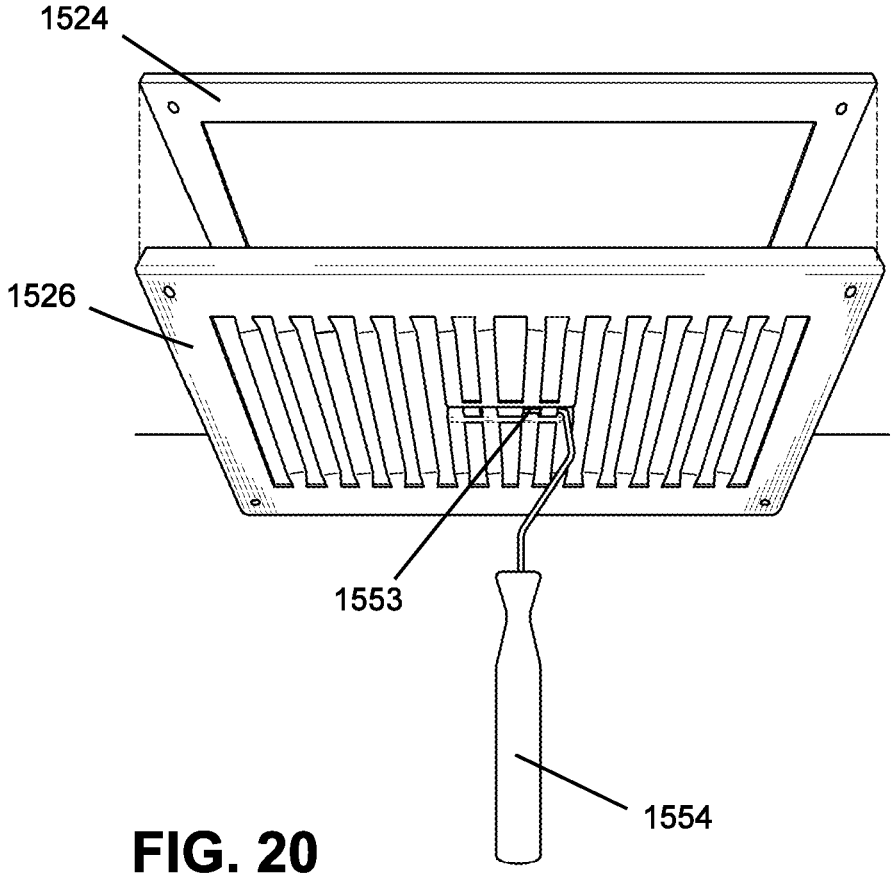
FIG. 20 is a front perspective view of the register cover of FIG. 17 being removed from a base according to the present disclosure.

FIGS. 19-20 illustrate removal of the register cover 1526 that is magnetically attached to a frame 1524 located on a ceiling of a room. In operation, a rod 1553 at an end of the tool 1554 engages the tool engagement feature 1540 via inserting the rod 1553 of the tool 1554 through the insertion holes 1552 of each forwardly projecting knuckle 1546. The plurality of concave surfaces 1544 are configured to guide the rod 1553 through the forwardly projecting knuckles 1546. In one example, when the rod 1553 of the tool 1554 is inserted through each insertion hole 1552, the tool 1554 is at a 90° angle relative to the ceiling. Next, the user exerts a pulling force via the tool 1554 to pull the register cover 1526 off the frame 1524. By providing a register cover 1526 magnetically attached to the frame 1524, as opposed to traditional screws, a user can install and remove the register cover 1526 quickly and conveniently. Furthermore, the tool 1554 may be a length sufficient to allow the user to install/remove the register cover 1526 without the use of a ladder for safer installation and removal.

The tool engagement feature 1540 is configured to permit the tool 1554 to rotate about an axis that passes through the forwardly projecting knuckles 1546 such that the tool 1554 can be positioned at any angle to install or remove the register cover 1526. As such, the tool engagement feature 1540 allows the user to operate the tool 1554 at any angle to accommodate the venting system 1522 disposed at any location on the wall and/or ceiling.

Figure 21:
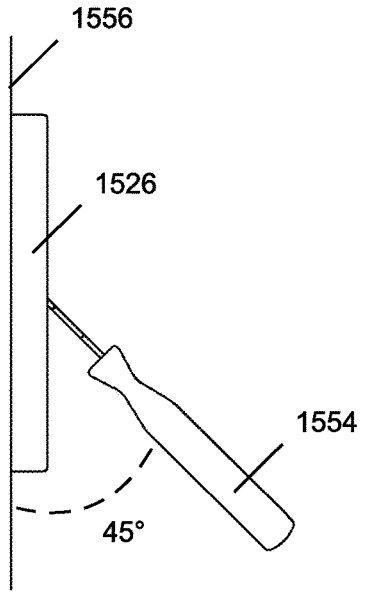
FIG. 21 is a side view of the register cover of FIG. 17 installed on a base located on a wall according to the present disclosure.

As shown in FIG. 21, in one specific example, the register cover 1526 is magnetically attached to the frame 1524 located at a top portion of a vertical wall 1556. When the tool 1554 is engaged with the tool engagement feature 1540, the tool 1554 is angled at about 45° relative to the vertical wall 1556.

Figure 22:
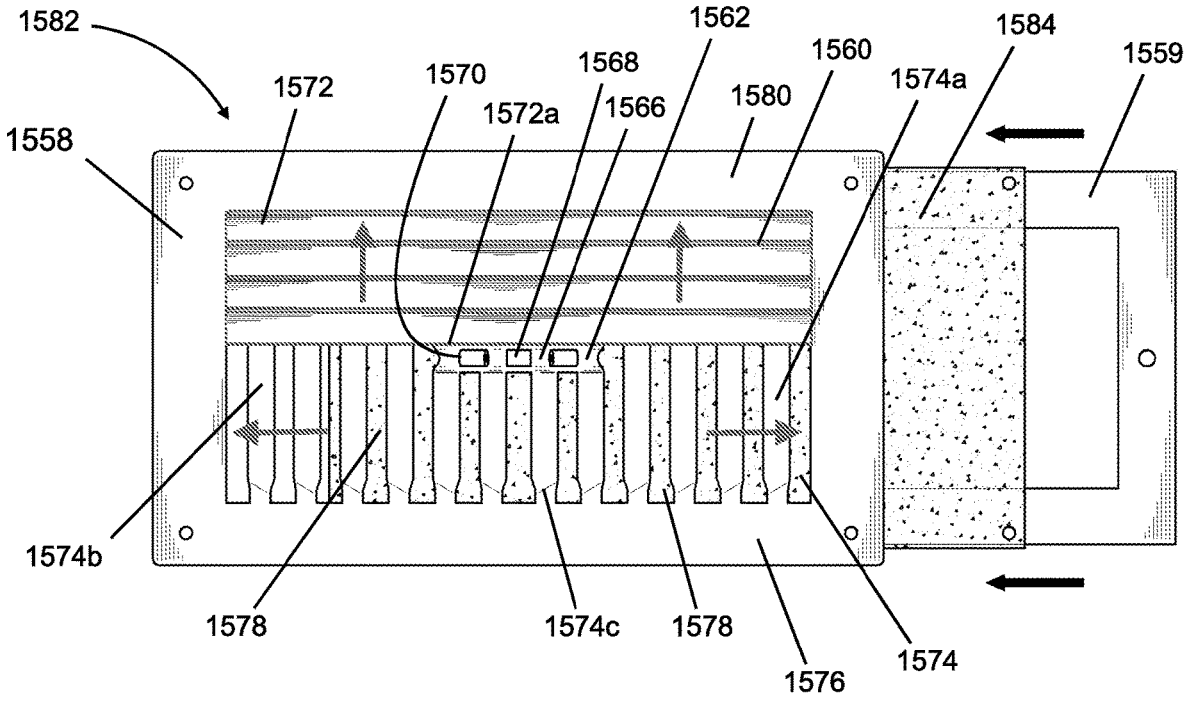
FIG. 22 is a front perspective view of a register cover according to another embodiment of the present disclosure.

Referring to FIG. 22, a venting system 1582, according to another embodiment of the present disclosure, includes a register cover 1558 configured to magnetically engage a frame 1559. The venting system 1582 can include a filter 1584 disposed between the frame 1559 and the register cover 1558. The filter 1584 is configured to filter, soften, and disperse the air coming out of the exit register where the register cover 1558 and filter 1584 is installed. The register cover 1558 includes a plurality of fins 1560 and a tool engagement feature 1562 disposed at a central portion 1564 of the register cover 1558. The tool engagement feature 1562 includes a plurality of concave surfaces 1566 and a plurality of forwardly projecting knuckles 1568 forming insertion holes 1570 for receiving a tool.

The plurality of fins 1560 are disposed in various orientations. The plurality of fins 1560 may include horizontally orientated fins 1572 and vertically orientated fins 1574. The horizontally orientated fins 1572 may be arranged above or below the tool engagement feature 1562. In the example shown in FIG. 22, the horizontally orientated fins 1572 are disposed above the tool engagement feature 1562 and the vertically orientated fins 1574 are arranged below the horizontal orientated fins 1572. Each horizontally orientated fin 1572 can be mounted to the register cover 1558 such that the direction of the air entering the room is diverts away from the center of the venting system 1582. The register cover 1558 can be removed from the frame 1559 and rotated to change the orientation of the horizontally orientated fins 1572 and thus change the direction of the air entering the room. For example, the register cover 1558 can be attached to the frame 1559 such that the air entering the room is diverted upwards, as shown in FIG. 22. The use can remove the register cover 1558, rotate the register cover 1558 180°, reattach the register cover 1558 to the frame 1559 such that the air entering the room is diverted downwards.

The vertically orientated fins 1574 include right side vertically orientated fins 1574*a* disposed to the right of the tool engagement feature 1562 and left side vertically orientated fins 1574*b* disposed to the left of the tool engagement feature 1562. The right side and left side vertically orientated fins 1574*a*, 1574*b* may extend from a bottom portion 1576 of the register cover 1558 to a bottom side of the lowest horizontally orientated fin 1572*a*. The vertically orientated fins 1574 further include midpoint vertically orientated fins 1574*c* disposed below the tool engagement feature 1562 extending from the bottom portion 1576 of the register cover 1558 to the tool engagement feature 1562. The midpoint vertically orientated fins 1574*c* may define a length less than a length of the right side and left side vertically orientated fins 1574*a*, 1574*b*. As air circulates and passes through the open areas 1578 defined by the plurality of fins 1560, the horizontally orientated fins 1572 diverts air upwards, the right side vertically orientated fins 1574*a* diverts air to the right, and the left side vertically orientated fins 1574*b* diverts air to the left. The midpoint vertically orientated fins 1574*c* may divert air to the right, left, and/or forward.

In one example, the each horizontally orientated fin 1572 may be pivotably mounted to the register cover and operable to pivot about a horizontal axis to change a direction of the air flow entering the room. The horizontally orientated fins 1572 can have a range of rotation of 180°.

It should be appreciated that one skilled in the art may scale the location and dimensions of the plurality of fins 1560, as desired. For example, the horizontally orientated fins 1572 may be disposed below the tool engagement feature 1562 and divert air downward. The right side vertically orientated fins 1574*a*, the left side vertically orientated fins 1574*b*, and the midpoint vertically orientated fins 1574*c* may be disposed between a top portion 1580 of the register cover 1558 and the highest horizontally orientated fin 1572.

Figure 23:
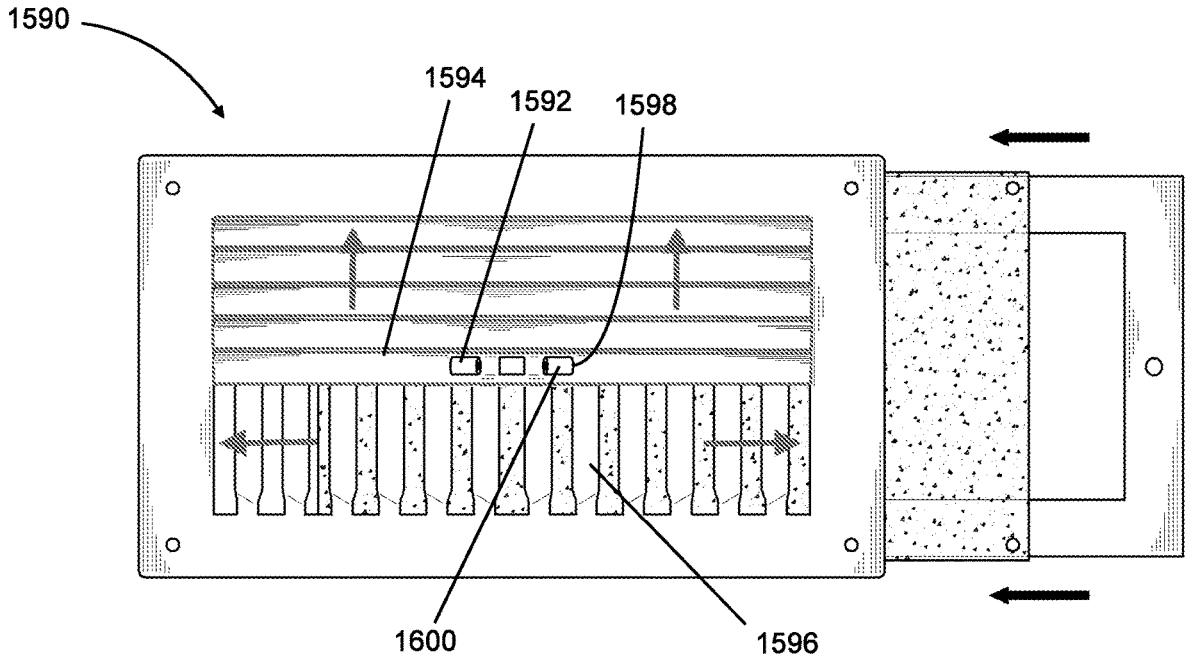
FIG. 23 is a front perspective view of a register cover according to another embodiment of the present disclosure.

Referring to FIG. 23, another embodiment of a venting system 1590 is shown. The venting system 1590 can have similar features as the venting system 1582 shown in FIG. 22, except that the venting system 1590 of FIG. 23 includes a tool engagement feature 1592 centrally located on a horizontally orientated fin 1594. Having the tool engagement feature 1592 located on the horizontally orientated fin 1594 allows for the rod 1553 of the tool 1554 to engage insertions holes 1598 of the forwardly projecting knuckles 1600 without being obstructed by the vertically orientated fins 1596. For example, a rod 1553 having a longer length may be more challenging to insert into the insertions holes 1598 without scratching the vertically orientated fins 1596.

The horizontally orientated fins 1572, 1594 and vertically orientated fins 1574, 1596 improve, soften, and disburse air entering the room thereby reducing undesired air pattern circulation issues.

While certain representative embodiments and details have been shown for purposes of illustrating the present disclosure, it will be apparent to those skilled in the art that various changes may be made without departing from the scope of the disclosure, which is further described in the following appended claims.

What is claimed is:

1. A system for improving air-quality of a space serviced by an exit register, comprising:

a frame configured to engage the exit register; and a register cover configured to be attached to the frame, the register cover including:

a plurality of alternating open areas and air diverting fins vertically orientated on the register cover, wherein the plurality of open areas includes three open areas disposed proximate a central portion of the register cover; and a tool engagement feature located at the central portion of the register cover, the tool engagement feature including a plurality of concave surfaces formed on at least four of the air diverting fins among the plurality of air diverting fins, and a forwardly projecting knuckle arranged at a center of each of the three open areas disposed proximate the central portion of the register cover.

2. The system of claim 1 further comprising a magnet configured to be disposed proximate a corner of the register cover and configured to magnetically engage the frame, wherein the magnet is wedge shaped.

3. The system of claim 1, wherein the register cover includes a magnet holder having a bottom portion that tapers inward thereby forming a lip.

4. The system of claim 1 further comprising a filter configured to be disposed between the frame and the register cover.

5. The system of claim 1, wherein half of the plurality of air diverting fins are pointed toward a left side of the register cover and half of the plurality of air diverting fins are pointed toward a right side of the register cover.

6. The system of claim 1, wherein each forwardly projecting knuckle defines an insertion hole for receiving a tool.

7. A system for improving air-quality of a space serviced by an exit register, comprising:

a register cover including:

a plurality of open areas including an open area disposed proximate a central portion of the register cover; and a plurality of air diverting fins arranged between adjacent open areas among the plurality of open areas, the plurality of air diverting fins including an air diverting fin disposed proximate the central portion of the register cover; and a tool engagement feature horizontally extending along the central portion of the register cover, wherein the tool engagement feature includes a concave surface and a forwardly projecting knuckle;

wherein the air diverting fin disposed proximate the central portion of the register cover defines the concave surface of the tool engagement feature, and the forwardly projecting knuckle is disposed at a center of the open area disposed proximate the central portion of the register cover.

8. The system of claim 7, wherein the plurality of open areas and the plurality of air diverting fins are vertically orientated on the register cover.

9. The system of claim 7 further comprising a frame and a magnet disposed proximate a corner of the register cover, the magnet configured to magnetically engage the frame.

10. The system of claim 7, wherein the register cover includes a magnet holder having a bottom portion that tapers inward thereby forming a lip.

11. A system for improving air-quality of a space serviced by an exit register, comprising:

a frame configured to engage the exit register; and a register cover configured to be attached to the frame, the register cover including:

a plurality of fins including horizontally orientated fins and vertically orientated fins; and a tool engagement feature extending along a central portion of the register cover, wherein the tool engagement feature includes a concave surface and a plurality of forwardly projecting knuckles.

12. The system of claim 11, wherein the horizontally orientated fins are pivotably mounted to the register cover.

13. The system of claim 12, wherein the horizontally orientated fins have a range of rotation of 180°.

14. The system of claim 11, wherein the horizontally orientated fins are arranged above the tool engagement feature and the vertically orientated fins are disposed below the horizontally orientated fins.

15. The system of claim 11, wherein the horizontally orientated fins are arranged below the tool engagement feature and the vertically orientated fins are disposed above the horizontally orientated fins.

16. The system of claim 11, wherein the vertically orientated fins include right side vertically orientated fins pointed to a right side of the register cover, left side vertically orientated fins pointed to a left side of the register cover, and midpoint vertically orientated fins arranged between the right side vertically orientated fins and the left side vertically orientated fins.

17. The system of claim 16, wherein the midpoint vertically orientated fins define a length that is less than a length of the right side vertically orientated fins and the left side vertically orientated fins.

18. The system of claim 11 further comprising a magnet disposed proximate a corner of the register cover, the magnet configured to magnetically engage the frame, wherein the magnet is wedge shaped.

19. The system of claim 11, wherein the register cover includes a magnet holder having a bottom portion that tapers inward thereby forming a lip.

20. The system of claim 11 further comprising a filter configured to be disposed between the frame and the register cover.

* * * * *